US006123161A

United States Patent [19]

Taylor

[11] Patent Number: 6,123,161

[45] Date of Patent: Sep. 26, 2000

[54] ROTARY DRILL BITS

[75] Inventor: Malcolm Roy Taylor, Gloucester, United Kingdom

[73] Assignee: Camco International (UK) Limited, Stonehouse, United Kingdom

[21] Appl. No.: 08/982,837

[22] Filed: Dec. 2, 1997

[30] Foreign Application Priority Data

Jun. 14, 1997 [GB] United Kingdom ..... 9712342

[51] Int. Cl.[7] ..... E21B 10/42

[52] U.S. Cl. ..... 175/397; 175/431

[58] Field of Search ..... 175/431, 432, 175/397, 415

[56] References Cited

U.S. PATENT DOCUMENTS

| | | | |
|---|---|---|---|
| 4,471,845 | 9/1984 | Jurgens | 175/329 |
| 5,244,039 | 9/1993 | Newton, Jr. et al. | 175/431 |
| 5,531,281 | 7/1996 | Murdock | 175/431 |
| 5,549,171 | 8/1996 | Mensa-Wilmot et al. | 175/431 |
| 5,551,522 | 9/1996 | Keith et al. | 175/420.2 |
| 5,582,261 | 12/1996 | Keith et al. | 175/431 |
| 5,607,024 | 3/1997 | Keith et al. | 175/431 |
| 5,607,025 | 3/1997 | Mensa-Wilmot et al. | 175/431 |
| 5,651,421 | 7/1997 | Newton et al. | 175/431 |
| 5,816,346 | 10/1998 | Beaton | 175/431 |

FOREIGN PATENT DOCUMENTS

| | | |
|---|---|---|
| 0575198 | 12/1993 | European Pat. Off. . |
| 0710765 | 5/1996 | European Pat. Off. . |
| 2086451 | 5/1982 | United Kingdom . |
| 2241266 | 8/1991 | United Kingdom . |
| 2294712 | 5/1993 | United Kingdom . |
| 2292163 | 2/1996 | United Kingdom . |

*Primary Examiner*—William Neuder
*Assistant Examiner*—Zakiya Walker
*Attorney, Agent, or Firm*—Jeffery E. Daly

[57] ABSTRACT

A rotary drill bit, for drilling holes in subsurface formations, comprises a bit body having a shank for connection to a drill string, a number of circumferentially spaced blades on the bit body extending outwardly away from the central axis of rotation of the bit, and a number of cutters mounted side-by-side along the leading edge of each blade. The cutters include primary cutters having cutting edges which define a primary cutting profile and secondary cutters having cutting edges which define a secondary cutting profile which is disposed inwardly of the primary cutting profile with respect to the bit body. The secondary cutters may be on different blades from the primary cutters, or may be mounted on the same blades, rearwardly of the primary cutters. At least the majority of the cutters are located at different distances away from the bit axis, so that as the bit rotates each secondary cutter follows a path which lies intermediate the paths followed by two primary cutters.

54 Claims, 3 Drawing Sheets

FIG 1
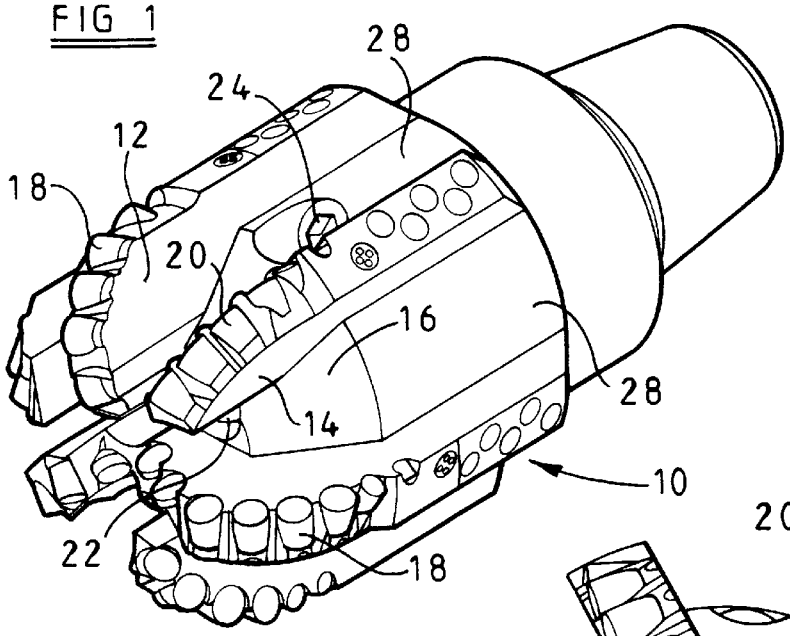
FIG 2
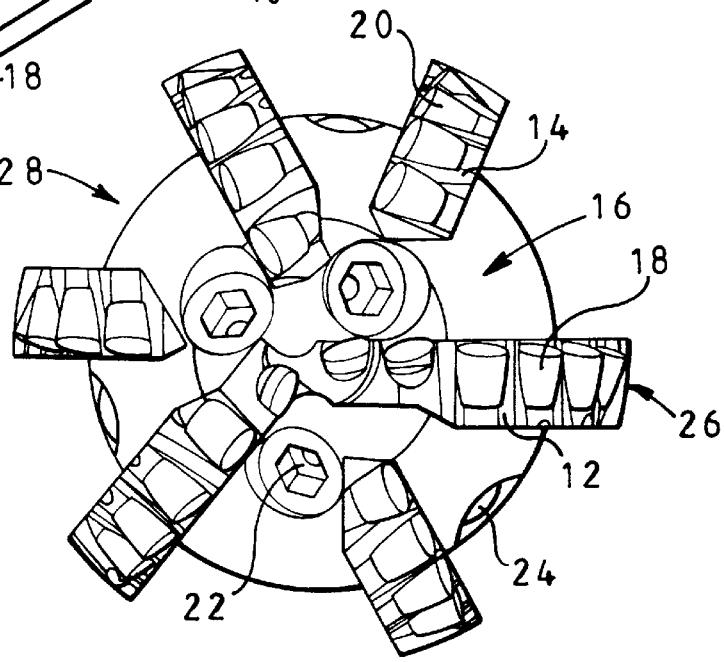
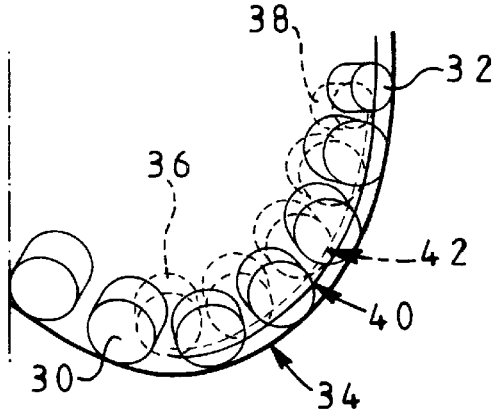
FIG 3

FIG 4
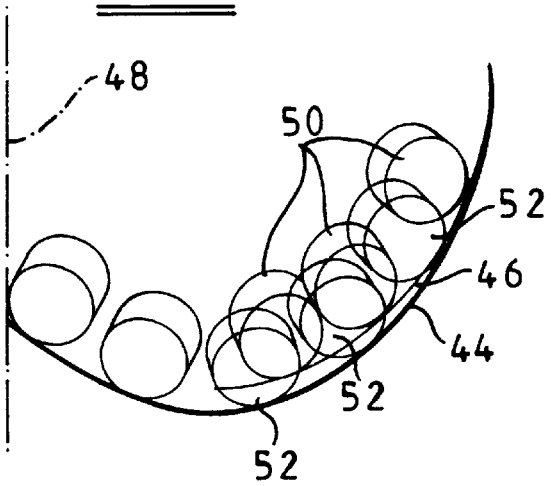
FIG 5
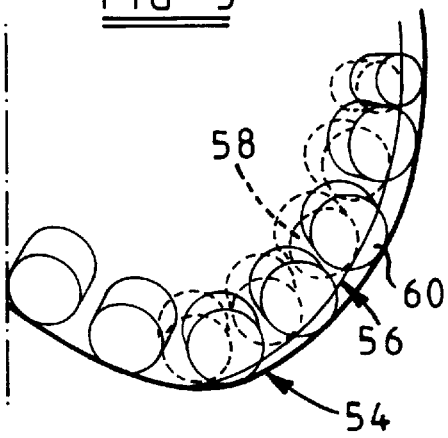
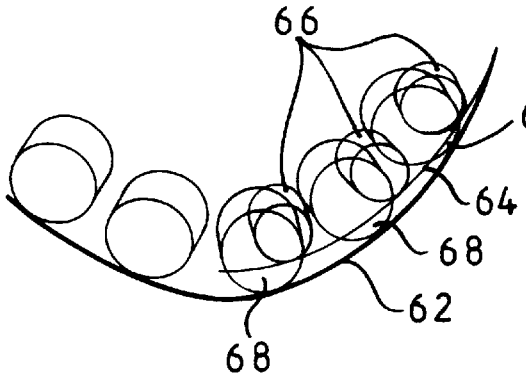
FIG 6
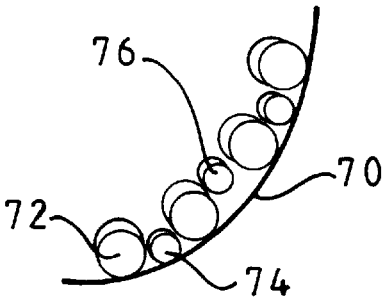
FIG 7

ROTARY DRILL BITS

BACKGROUND OF THE INVENTION

1. Field of the Invention

The invention relates to rotary drill bits for use in drilling holes in subsurface formations, and of the kind comprising a bit body having a shank for connection to a drill string, a plurality of circumferentially spaced blades on the bit body extending outwardly away from the central axis of rotation of the bit, and a plurality of cutting elements mounted along each blade.

2. Description of Related Art

The invention is particularly, but not exclusively, applicable to drill bits in which some or all of the cutters are preformed (PDC) cutters each formed, at least in part, from polycrystalline diamond. One common form of cutter comprises a tablet, usually circular or part-circular, made up of a superhard table of polycrystalline diamond, providing the front cutting face of the element, bonded to a substrate which is usually of cemented tungsten carbide.

The bit body may be machined from solid metal, usually steel, or may be moulded using a powder metallurgy process in which tungsten carbide powder is infiltrated with a metal alloy binder in a furnace so as to form a hard matrix.

The cutters on the drill bit have cutting edges which, together, define an overall cutting profile which defines the surface shape of the bottom of the bore hole which the bit drills. Preferably the cutting profile is substantially continuous over the leading face of the bit so as to form a comparatively smooth bottom hole profile.

In some drill bits of the above kind, there are associated with at least some of the cutters further secondary cutters each of which is circumferentially spaced from an associated primary cutter but is disposed at substantially the same distance from the axis of the bit as the associated primary cutter, so as to "track" the primary cutter as the bit rotates. That is to say, the secondary cutter follows the groove cut in the formation by its associated primary cutter as the bit rotates. In such arrangements the secondary cutters may be so disposed that their cutting edges lie inwardly of the profile defined by the primary cutters so that each secondary cutter serves as a back-up to its associated primary cutter and only performs an effective cutting action on the formation should the primary cutter become damaged or worn so that it is no longer effective.

SUMMARY OF THE INVENTION

According to the invention there is provided a rotary drill bit for drilling holes in subsurface formations, comprising a bit body having a shank for connection to a drill string, a plurality of circumferentially spaced blades on the bit body extending outwardly away from the central axis of rotation of the bit, and a plurality of cutters mounted along each blade, at least the majority of which cutters are located at different distances away from the bit axis, said cutters including primary cutters having cutting edges which define a primary cutting profile and secondary cutters having cutting edges which define a secondary cutting profile which is disposed inwardly of the primary cutting profile with respect to the bit body.

The arrangement according to the invention differs significantly from the prior art mentioned above in that at least the majority of the secondary cutters, instead of tracking associated primary cutters, are located at different positions as compared to the primary cutters so that no tracking occurs. The secondary cutters will thus make some contribution to the cutting of the formation at all times, the contribution increasing as the primary cutters wear. When the drill bit is new, and the primary cutters perform most of the cutting action, a high rate of penetration may be achieved particularly in softer formations. At the same time, however, the fact that the secondary cutters lie on a lower profile may facilitate the flow of drilling fluid between the secondary cutters and across the secondary blades, thereby reducing the tendency for bit "balling" to occur, where soft sticky formation accumulates on the surface of the bit around the cutters.

As drilling progresses, and firmer formations are met, the primary cutters experience wear and the secondary cutters begin to make a bigger contribution to the drilling action resulting in a smoother bottom hole profile. This may improve the steerability of the drill bit when used with a steering system.

The primary cutters may be mounted on primary blades and at least some of the secondary cutters mounted on separate secondary blades. The primary blades and secondary blades may be spaced alternately apart around the axis of rotation of the bit.

There may be fewer secondary cutters on each secondary blade than there are primary cutters on each primary blade. The primary blades may be longer than the secondary blades so as to extend into said central region of the bit body.

Each secondary blade may be associated with a particular primary blade, each secondary cutter then being located at a position, with respect to the bit axis, which is intermediate the positions of two adjacent primary cutters on its associated primary blade. In this case each secondary blade may be the next adjacent blade rearwardly of its associated primary blade with respect to the normal direction of rotation of the drill bit.

In another embodiment of the invention at least some of said secondary cutters may be mounted on the same blades as at least some of the primary cutters. For example, the secondary cutters may be disposed rearwardly of the primary cutters on the same blade, with respect to the normal direction of forward rotation of the drill bit. The secondary cutters may be mounted on an outer region of the blade.

The number of secondary cutters may be less than the number of primary cutters on the same blade. For example, the bit body may include a central region around the axis of rotation of the bit where only primary cutters are mounted.

The secondary cutters may include cutters which are smaller or larger than at least the majority of the primary cutters. At least the majority of the secondary cutters may be smaller or larger than at least the majority of the primary cutters.

The secondary cutters may be of different sizes. For example, larger secondary cutters may be arranged alternately with smaller secondary cutters along the length of a blade.

In any of the above arrangements at least some of the secondary cutters may be set at different back rake angles from at least some of the primary cutters. They may be set at a greater or smaller back rake angle than the primary cutters.

In any of the above arrangements also, the distance between the primary cutting profile and the secondary cutting profile may substantially constant over the surface of the bit, or may increase or decrease with distance from the axis of rotation of the bit.

The bit body may be provided with a plurality of nozzles for the delivery of drilling fluid to the surface of the bit for cooling and cleaning the cutters, the nozzles including inner nozzles each of which is located to direct drilling fluid outwardly along the primary cutters on a primary blade, and outer nozzles each of which is located to direct drilling fluid inwardly along the secondary cutters on a secondary blade.

The invention also includes within its scope a rotary drill bit for drilling holes in subsurface formations, comprising a bit body having a shank for connection to a drill string, a plurality of circumferentially spaced blades on the bit body extending outwardly away from the central axis of rotation of the bit, and a plurality of cutters mounted along each blade, said cutters including primary cutters, at least the majority of which are located at different distances away from the bit axis, and secondary cutters which are located at different distances away from the bit axis, as compared to the primary cutters, so that no secondary cutter tracks a primary cutter, at least some of said secondary cutters being mounted on the same blades as at least some of the primary cutters.

In this embodiment of the invention said primary cutters may have cutting edges which define a primary cutting profile and said secondary cutters have cutting edges which define a secondary cutting profile which is disposed inwardly of the primary cutting profile with respect to the bit body.

BRIEF DESCRIPTION OF THE DRAWINGS

FIG. 1 is a perspective view of a PDC drill bit in accordance with the present invention;

FIG. 2 is an end view of the drill bit shown in FIG. 1.

FIG. 3 is a diagrammatic representation of one arrangement of primary and secondary cutters on the drill bit.

FIGS. 4 to 7 are similar views to FIG. 3 of alternative cutter arrangements.

DETAILED DESCRIPTION OF THE PREFERRED EMBODIMENTS

Figure 8:
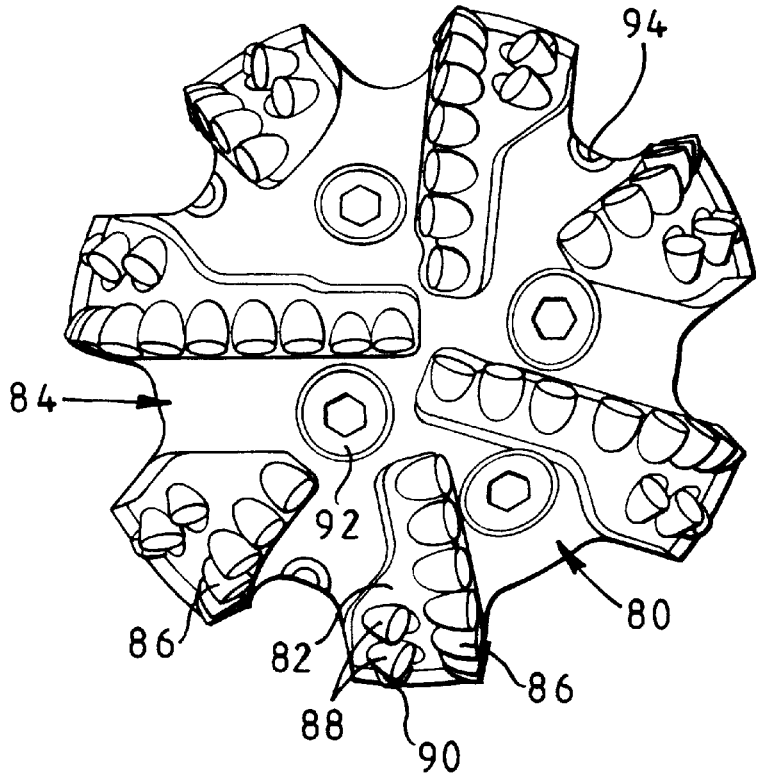
FIG. 8 is an end view of another form of PDC drill bit in accordance with the present invention.

Referring to FIGS. 1 and 2, the drill bit comprises a bit body 10 having a leading face formed with six blades extending outwardly away from the axis of the bit body towards the gauge region. The blades comprise three longer primary blades 12 alternately spaced with three shorter secondary blades 14. Between adjacent blades there are defined fluid channels 16.

Extending side by side along each of the primary blades 12 is a plurality of primary cutters 18 and extending along each of the secondary blades 14 is a plurality of secondary cutters 20. The precise nature of the cutters does not form a part of the present invention and they may be of any appropriate type. For example, as shown, they may comprise circular preformed cutting elements brazed to cylindrical carriers which are imbedded or otherwise mounted in the blades, the cutting elements each comprising a preformed compact having a polycrystalline diamond front cutting table bonded to a tungsten carbide substrate, the compact being brazed to a cylindrical tungsten carbide carrier. Alternatively, substrate of the preformed compact may itself be of sufficient length to be mounted directly in the blade, the additional carrier then being omitted.

The secondary cutters 20 may be of the same type as the primary cutters 18 or the primary and secondary cutters may be of different types.

Inner nozzles 22 are mounted in the surface of the bit body and are located in a central region of the bit body, fairly close to the axis of rotation of the drill bit. Each inner nozzle 22 is so located that it can deliver drilling fluid to two or more of the channels 16, but is so orientated that it primarily delivers drilling fluid outwardly along a channel 16 on the leading side of one of the three primary blades 12.

In addition, outer nozzles 24 are located at the outer extremity of each channel on the leading side of each secondary blade 14. The outer nozzles are orientated to direct drilling fluid inwardly along their respective channels towards the centre of the drill bit, such inwardly flowing drilling fluid becoming entrained with the drilling fluid from the associated inner nozzle 22 so as to flow outwardly to the gauge region again along the adjacent channel. All the nozzles communicate with a central axial passage (not shown) in the shank of the bit to which drilling fluid is supplied under pressure downwardly through the drill string in known manner.

The outer extremities of the blades 12, 14 are formed with kickers 26 which provide part-cylindrical bearing surfaces which, in use, bear against the surrounding wall of the bore hole and stabilise the bit in the bore hole. Abrasion-resistant bearing elements (not shown), of any suitable known form, are imbedded in the bearing surfaces.

Each of the channels 16 between the blades leads to a respective junk slot 28. The junk slots extend upwardly between the kickers 26, so that drilling fluid flowing outwardly along each channel passes into the associated junk slot and flows upwardly, between the bit body and the surrounding formation, into the annulus between the drill string and the wall of the bore hole.

Each of the secondary blades 14 is associated with the immediately preceding primary blade 12. In other arrangements, however, the associated primary and secondary blades need not be immediately adjacent one another but may be in any relative positions on the leading face of the bit.

FIG. 3 is a diagrammatic half section through the leading end of the drill bit showing one possible arrangement of primary cutters (shown in solid line) along their primary blade and also (in dotted lines) the corresponding positions, with respect to the bit axis, of the associated secondary cutters. As previously explained, the secondary cutters may be in any circumferential position on the drill bit relative to the primary cutters.

In the arrangement shown in FIG. 3, the primary blade has mounted thereon six primary cutters 30 which are all of substantially the same size and a smaller outermost primary cutter 32 at the gauge. The primary cutters are spaced substantially equally apart along the length of the primary blade. The cutting edges of the primary cutters define a primary cutting profile indicated diagrammatically at 34.

The secondary cutters 36, 38 comprise four cutters which are substantially similar in size and type to the primary cutters 30 and a single smaller outermost secondary cutter 38. As may be seen from FIG. 3, each secondary cutter 36, 38 is disposed at a position, with respect to the bit axis, which is intermediate the positions of two adjacent primary cutters, i.e. for each secondary cutter the cutter which is next closest to the bit axis and the cutter which is next furthest from the bit axis are both primary cutters. The secondary cutters define a secondary cutting profile, indicated in solid line at 40 in FIG. 3, which is spaced inwardly of the primary cutting profile 34.

It will thus be seen that, when the drill bit is new, the primary cutters will cut grooves in the formation leaving upstanding kerfs between the grooves, and the top of the kerfs will then be removed by the following secondary cutters. Since the secondary cutters are set to define a lower cutting profile, drilling fluid delivered through the inner and outer nozzles 22, 24 can more easily flow over the secondary blades 14 and between the secondary cutters on the blades, so as to prevent the balling of cuttings in this region.

As the primary cutters 30 wear, or become damaged, the secondary cutters 36 will take over a greater proportion of the cutting action and the profile of the bottom of the hole will become smoother as the primary cutting profile 34 moves inwardly closer to the secondary cutting profile 40.

In the arrangement of FIG. 3, the secondary cutters 36, 38 could be set even further inwardly with respect to the primary cutters so as to define a more inward cutting profile as indicated in dotted line at 42.

In the arrangement of FIG. 3, the spacing between the primary cutting profile 34 and secondary cutting profile 40 is substantially constant over the face of the drill bit. FIG. 4 shows an arrangement where the distance between the primary cutting profile 44 and the secondary profile 46 decreases with distance from the central axis 48 of the drill bit.

In this case, the outer secondary cutters 50 are displaced outwardly with respect to the primary cutters 52, the displacement increasing with distance from the bit axis 48.

FIG. 5 shows an arrangement where the distance between the primary cutting profile 54 and secondary profile 56 increases with distance from the bit axis. This arrangement is otherwise generally similar to that of FIG. 3 in that each secondary cutter 58 is disposed at a location intermediate to primary cutters 60 on its associated primary blade.

FIG. 6 also shows an arrangement where the distance between the primary cutting profile 62 and secondary profile 64 decreases with distance from the bit axis. In this arrangement, however, the secondary cutters 66 are smaller in diameter than the primary cutters 68. As will be seen from FIG. 6, the overlap between the secondary cutters and the primary cutters varies along the two blades.

FIG. 7 shows an arrangement of secondary cutters only, defining a secondary cutting profile 70, where the secondary cutters comprise larger cutters 72 alternating with smaller cutters 74. It is not necessary that all secondary cutters (or indeed all primary cutters) be on the same cutting profile and FIG. 7 shows an arrangement where one of the smaller cutters 76 on a secondary blade has a cutting edge spaced inwardly of the secondary cutting profile 70. The primary cutters on the primary blades may have a similar arrangement.

In all of the above described arrangements at least the majority, and preferably all, of the primary cutters are located at different distances away from the bit axis, and at least he majority of the secondary cutters are located at different distances away from the axis, as compared to the primary cutters, so that, as may be seen from the drawings, none of such secondary cutters then tracks a primary cutter. Arrangements are also possible where all of the secondary cutters are located at different distances from the bit axis, as compared to the primary cutters, so that no secondary cutter tracks a primary cutter.

In any of the above arrangements the primary cutters may be of the same size, or larger or smaller, than the secondary cutters. The primary cutters may also be arranged at different back rake angles from the secondary cutters, and the back rake angle of the primary cutters may be greater or less than the back rake angle of the secondary cutters.

In the drill bit shown in FIGS. 1 and 2 the primary cutters are mounted on primary blades and the secondary cutters are mounted on separate secondary blades spaced circumferentially from the primary blades. FIG. 8 shows an alternative construction where the secondary cutters are mounted on the same blades as the primary cutters.

Referring to FIG. 8, the drill bit comprises a bit body 80 having a leading face formed with seven blades 82 extending outwardly away from the axis of the bit towards the gauge region. Between adjacent blades there are defined fluid channels 84.

Extending side-by-side along the leading edge of each blade 82 is a plurality of primary cutters 86. On each blade two secondary cutters 88 are mounted rearwardly of the primary cutters 86 at the outer end of the blade 82. A diamond impregnated abrasion element 90 is also mounted in the blade outwardly of the secondary cutters 88.

As in the previously described arrangements, both the primary and secondary cutters may comprise circular preformed cutting elements which are mounted in sockets in the blades, the cutting elements each comprising a preformed compact having a polycrystalline diamond front cutting table bonded to a tungsten carbide substrate. The secondary cutters 88 may be of the same type as the primary cutters 86 or the primary and secondary cutters may be of different types.

Inner nozzles 92 are mounted in the surface of the bit body fairly close to the axis of rotation of the bit, and outer nozzles 94 are located at the outer extremities of some of the fluid channels 84.

The primary cutters 86 are located at different distances from the bit axis so that, as the bit rotates, the cutting edges of the primary cutters define a cutting profile which extends over the whole of the bottom of the borehole being drilled. The secondary cutters 88 are located at different distances away from the bit axis, as compared to the primary cutters 86, so that none of the secondary cutters 88 tracks a primary cutter. The secondary cutters may, in accordance with one aspect of the present invention, define a secondary cutting profile which is disposed inwardly, with respect to the bit body, of the primary cutting profile defined by the primary cutters 86. However, the drill bit of FIG. 8 may also be constructed so that the cutting edges of the secondary cutters 88 lie on the same profile as the cutting edges of the primary cutters 86.

FIGS. 9 to 12 show diagrammatic sections through adjacent primary and secondary cutters on a drill bit of the kind shown in FIG. 8. For convenience the secondary cutters are shown lying in the same plane as the primary cutters but, in practice, in accordance with the present invention, the secondary cutters will be mounted at a different distance from the axis of rotation of the drill bit so that the secondary cutter does not track the primary cutter.

Figure 9:
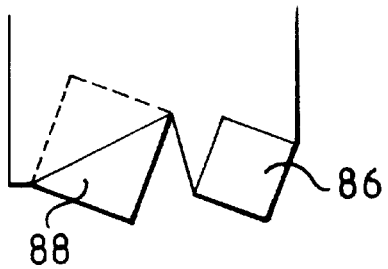
FIGS. 9 to 12 are diagrammatic sections through a blade in a drill bit of the kind shown in FIG. 8, showing alternative configurations of primary and secondary cutters.
Figure 10:
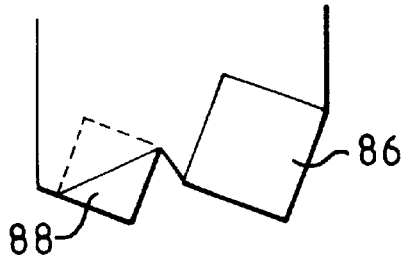

Referring to FIG. 9, there is shown a secondary cutter 88 which is of larger diameter than the primary cutter 86 and is disposed at the same back rake angle. FIG. 10 shows an arrangement where the primary cutter 86 is of greater diameter than the secondary cutter 88.

Figure 11:
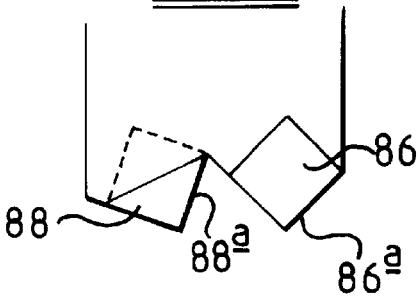
Figure 12:
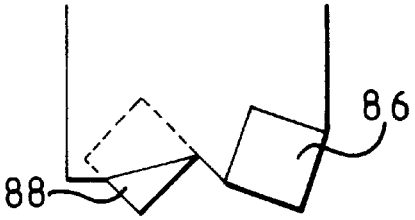

In the arrangement of FIG. 11 the primary cutter 86 and secondary cutter 88 are both of the same size, but the front cutting face **88*a* of the secondary cutter is disposed at a greater back rake angle than the front cutting face 86*a* of the associated primary cutter 86. FIG. 12 shows the opposite arrangement where the back rake angle of the primary cutter 86 is greater than the back rake angle of the secondary cutter 88**.

In all of the arrangements shown in FIGS. 9–12 the cutting edges of both the primary and secondary cutters lie on substantially the same profile. However, as previously explained, in accordance with one aspect of the present invention, the cutting edges of the secondary cutters 88 may define a cutting profile which is disposed inwardly of the cutting profile defined by the cutting edges of the primary cutters.

Whereas the present invention has been described in particular relation to the drawings attached hereto, it should be understood that other and further modifications, apart from those shown or suggested herein, may be made within the scope and spirit of the present invention.

What is claimed:

1. A rotary drill bit for drilling holes in subsurface formations, the bit having a central axis of rotation and comprising a bit body having a shank for connection to a drill string, a plurality of circumferentially spaced blades on the bit body extending outwardly away from said central axis of rotation of the bit, and a plurality of cutters mounted along each blade, at least a majority of which cutters are each located at a different distance from the bit axis than any other cutter, said cutters including primary cutters having cutting edges which define a primary cutting profile and secondary cutters having cutting edges which define a secondary cutting profile which is disposed inwardly of the primary cutting profile with respect to the bit body wherein the primary cutters are mounted on primary blades and at least some of the secondary cutters are mounted on separate secondary blades and there are fewer secondary cutters on each secondary blade than there are primary cutters on each primary blade.

2. A drill bit according to claim 1, wherein the primary blades and secondary blades are spaced alternately apart around the axis of rotation of the bit.

3. A drill bit according to claim 1, wherein each secondary cutter is disposed at a position, with respect to the axis of rotation of the bit, which is intermediate the positions of two adjacent primary cutters with respect to the axis of rotation of the bit.

4. A drill bit according to claim 3, wherein said two adjacent primary cutters lie on the same blade as said secondary cutter.

5. A drill bit according to claim 1, wherein each secondary blade is associated with a particular primary blade, each secondary cutter then being located at a position, with respect to the axis of rotation of the bit, which is intermediate the positions of two adjacent primary cutters on its associated primary blade.

6. A drill bit according to claim 5, wherein each secondary blade is the next adjacent blade rearwardly of its associated primary blade with respect to a normal direction of rotation of the drill bit.

7. A drill bit according to claim 1, wherein at least some of said secondary cutters are mounted on the same blades as at least some of the primary cutters.

8. A drill bit according to claim 7, wherein said secondary cutters are disposed rearwardly of the primary cutters on the same blade, with respect to a normal direction of forward rotation of the drill bit.

9. A drill bit according to claim 7, wherein said secondary cutters are mounted on an outer region of the blade.

10. A drill bit according to claim 7, wherein there are fewer secondary cutters than primary cutters on the same blade.

11. A drill bit according to claim 1, wherein the bit body includes a central region around the axis of rotation of the bit where only primary cutters are mounted.

12. A drill bit according to claim 1, wherein the secondary cutters include cutters which are smaller than at least the majority of the primary cutters.

13. A drill bit according to claim 12, wherein at least the majority of the secondary cutters are smaller than at least the majority of the primary cutters.

14. A drill bit according to claim 12, wherein at least the majority of the secondary cutters are larger than at least the majority of the primary cutters.

15. A drill bit according to claim 1, wherein at least some of the secondary cutters are set at different back rake angles from at least some of the primary cutters.

16. A drill bit according to claim 15, wherein at least some of the secondary cutters are set at a greater back rake angle than at least some of the primary cutters.

17. A drill bit according to claim 15, wherein at least some of the secondary cutters are set at a smaller back rake angle than at least some of the primary cutters.

18. A drill bit according to claim 1, wherein the primary cutting profile is a distance from the secondary cutting profile which is substantially constant over the surface of the bit.

19. A drill bit according to claim 1, wherein the bit body is provided with a plurality of nozzles for delivery of drilling fluid to a surface of the bit for cooling and cleaning the cutters, the nozzles including inner nozzles each of which is located to direct drilling fluid outwardly along the primary cutters on a primary blade, and outer nozzles each of which is located to direct drilling fluid inwardly along the secondary cutters on a secondary blade.

20. A rotary drill bit for drilling holes in subsurface formations, the bit having a central axis of rotation and comprising a bit body having a shank for connection to a drill string, a plurality of circumferentially spaced blades on the bit body extending outwardly away from said central axis of rotation of the bit, and a plurality of cutters mounted along each blade, at least a majority of which cutters are each located at a different distance from the bit axis than any other cutter, said cutters including primary cutters having cutting edges which define a primary cutting profile and secondary cutters having cutting edges which define a secondary cutting profile which is disposed inwardly of the primary cutting profile with respect to the bit body wherein the primary cutters are mounted on primary blades and at least some of the secondary cutters are mounted on separate secondary blades, the primary blades are longer than the secondary blades so as to extend into said central region of the bit body.

21. A drill bit according to claim 20, wherein the primary blades and secondary blades are spaced alternately apart around the axis of rotation of the bit.

22. A drill bit according to claim 20, wherein each secondary cutter is disposed at a position, with respect to the axis of rotation of the bit, which is intermediate the positions of two adjacent primary cutters with respect to the axis of rotation of the bit.

23. A drill bit according to claim 22, wherein said two adjacent primary cutters lie on the same blade as said secondary cutter.

24. A drill bit according to claim 20, wherein each secondary blade is associated with a particular primary blade, each secondary cutter then being located at a position, with respect to the axis of rotation of the bit, which is intermediate the positions of two adjacent primary cutters on its associated primary blade.

25. A drill bit according to claim 24, wherein each secondary blade is the next adjacent blade rearwardly of its associated primary blade with respect to a normal direction of rotation of the drill bit.

26. A drill bit according to claim 20, wherein at least some of said secondary cutters are mounted on the same blades as at least some of the primary cutters.

27. A drill bit according to claim 26, wherein said secondary cutters are disposed rearwardly of the primary cutters on the same blade, with respect to a normal direction of forward rotation of the drill bit.

28. A drill bit according to claim 26, wherein said secondary cutters are mounted on an outer region of the blade.

29. A drill bit according to claim 26, wherein there are fewer secondary cutters than primary cutters on the same blade.

30. A drill bit according to claim 20, wherein the bit body includes a central region around the axis of rotation of the bit where only primary cutters are mounted.

31. A drill bit according to claim 20, wherein the secondary cutters include cutters which are smaller than at least the majority of the primary cutters.

32. A drill bit according to claim 31, wherein at least the majority of the secondary cutters are smaller than at least the majority of the primary cutters.

33. A drill bit according to claim 31, wherein at least the majority of the secondary cutters are larger than at least the majority of the primary cutters.

34. A drill bit according to claim 20, wherein at least some of the secondary cutters are set at different back rake angles from at least some of the primary cutters.

35. A drill bit according to claim 34, wherein at least some of the secondary cutters are set at a greater back rake angle than at least some of the primary cutters.

36. A drill bit according to claim 34, wherein at least some of the secondary cutters are set at a smaller back rake angle than at least some of the primary cutters.

37. A drill bit according to claim 20, wherein the primary cutting profile is a distance from the secondary cutting profile which is substantially constant over the surface of the bit.

38. A drill bit according to claim 20, wherein the bit body is provided with a plurality of nozzles for delivery of drilling fluid to a surface of the bit for cooling and cleaning the cutters, the nozzles including inner nozzles each of which is located to direct drilling fluid outwardly along the primary cutters on a primary blade, and outer nozzles each of which is located to direct drilling fluid inwardly along the secondary cutters on a secondary blade.

39. A rotary drill bit for drilling holes in subsurface formations, the bit having a central axis of rotation and comprising a bit body having a shank for connection to a drill string, a plurality of circumferentially spaced blades on the bit body extending outwardly away from said central axis of rotation of the bit, and a plurality of cutters mounted along each blade, at least a majority of which cutters are each located at a different distance from the bit axis than any other cutter, said cutters including primary cutters having cutting edges which define a primary cutting profile and secondary cutters having cutting edges which define a secondary cutting profile which is disposed inwardly of the primary cutting profile with respect to the bit body wherein the secondary cutters are of different sizes.

40. A drill bit according to claim 39, wherein at least some of the secondary cutters are set at different back rake angles from at least some of the primary cutters.

41. A drill bit according to claim 40, wherein at least some of the secondary cutters are set at a greater back rake angle than at least some of the primary cutters.

42. A drill bit according to claim 40, wherein at least some of the secondary cutters are set at a smaller back rake angle than at least some of the primary cutters.

43. A drill bit according to claim 39, wherein the primary cutting profile is a distance from the secondary cutting profile which is substantially constant over the surface of the bit.

44. A drill bit according to claim 39, wherein the bit body is provided with a plurality of nozzles for delivery of drilling fluid to a surface of the bit for cooling and cleaning the cutters, the nozzles including inner nozzles each of which is located to direct drilling fluid outwardly along the primary cutters on a primary blade, and outer nozzles each of which is located to direct drilling fluid inwardly along the secondary cutters on a secondary blade.

45. A rotary drill bit for drilling holes in subsurface formations, the bit having a central axis of rotation and comprising a bit body having a shank for connection to a drill string, a plurality of circumferentially spaced blades on the bit body extending outwardly away from said central axis of rotation of the bit, and a plurality of cutters mounted along each blade, at least a majority of which cutters are each located at a different distance from the bit axis than any other cutter, said cutters including primary cutters having cutting edges which define a primary cutting profile and secondary cutters having cutting edges which define a secondary cutting profile which is disposed inwardly of the primary cutting profile with respect to the bit body wherein the secondary cutters are of different size and larger secondary cutters are arranged alternately with smaller secondary cutters longitudinally of a blade.

46. A drill bit according to claim 45, wherein at least some of the secondary cutters are set at different back rake angles from at least some of the primary cutters.

47. A drill bit according to claim 46, wherein at least some of the secondary cutters are set at a greater back rake angle than at least some of the primary cutters.

48. A drill bit according to claim 46, wherein at least some of the secondary cutters are set at a smaller back rake angle than at least some of the primary cutters.

49. A drill bit according to claim 45, wherein the primary cutting profile is a distance from the secondary cutting profile which is substantially constant over the surface of the bit.

50. A drill bit according to claim 45, wherein the bit body is provided with a plurality of nozzles for delivery of drilling fluid to a surface of the bit for cooling and cleaning the cutters, the nozzles including inner nozzles each of which is located to direct drilling fluid outwardly along the primary cutters on a primary blade, and outer nozzles each of which is located to direct drilling fluid inwardly along the secondary cutters on a secondary blade.

51. A rotary drill bit for drilling holes in subsurface formations, the bit having a central axis of rotation and comprising a bit body having a shank for connection to a drill string, a plurality of circumferentially spaced blades on the bit body extending outwardly away from said central axis of rotation of the bit, and a plurality of cutters mounted along each blade, at least a majority of which cutters are each located at a different distance from the bit axis than any other cutter, said cutters including primary cutters having cutting edges which define a primary cutting profile and secondary cutters having cutting edges which define a secondary cutting profile which is disposed inwardly of the primary cutting profile with respect to the bit body wherein the primary cutting profile is a distance from the secondary cutting profile which increases with distance from the axis of rotation of the bit.

52. A drill bit according to claim 51, wherein the bit body is provided with a plurality of nozzles for delivery of drilling fluid to a surface of the bit for cooling and cleaning the cutters, the nozzles including inner nozzles each of which is located to direct drilling fluid outwardly along the primary cutters on a primary blade, and outer nozzles each of which is located to direct drilling fluid inwardly along the secondary cutters on a secondary blade.

53. A rotary drill bit for drilling holes in subsurface formations, the bit having a central axis of rotation and comprising a bit body having a shank for connection to a drill string, a plurality of circumferentially spaced blades on the bit body extending outwardly away from said central axis of rotation of the bit, and a plurality of cutters mounted along each blade, at least a majority of which cutters are each located at a different distance from the bit axis than any other cutter, said cutters including primary cutters having cutting edges which define a primary cutting profile and secondary cutters having cutting edges which define a secondary cutting profile which is disposed inwardly of the primary cutting profile with respect to the bit body wherein the primary cutting profile is a distance from the secondary cutting profile which decreases with distance from the axis of rotation of the bit.

54. A drill bit according to claim 53, wherein the bit body is provided with a plurality of nozzles for delivery of drilling fluid to a surface of the bit for cooling and cleaning the cutters, the nozzles including inner nozzles each of which is located to direct drilling fluid outwardly along the primary cutters on a primary blade, and outer nozzles each of which is located to direct drilling fluid inwardly along the secondary cutters on a secondary blade.

* * * * *